US006358661B1

(12) United States Patent
Dickerson et al.

(10) Patent No.: US 6,358,661 B1
(45) Date of Patent: Mar. 19, 2002

(54) VISUALLY ADAPTIVE RADIOGRAPHIC FILM AND IMAGING ASSEMBLY

(75) Inventors: Robert E. Dickerson, Hamlin; Mark P. Pavlik, Rochester, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/706,981

(22) Filed: Nov. 6, 2000

(51) Int. Cl.[7] ..... G03C 1/46; G03C 5/16; G03C 5/17; G03C 1/035

(52) U.S. Cl. ..... 430/139; 430/497; 430/502; 430/966; 430/967

(58) Field of Search ..... 430/139, 502, 430/509, 966, 967, 497

(56) References Cited

U.S. PATENT DOCUMENTS

| | | | | |
|---|---|---|---|---|
| 4,803,150 A | 2/1989 | Dickerson et al. | ..... | 430/502 |
| 4,900,652 A | 2/1990 | Dickerson et al. | ..... | 430/502 |
| 4,994,355 A | 2/1991 | Dickerson et al. | ..... | 430/509 |
| 4,997,750 A | 3/1991 | Dickerson et al. | ..... | 430/509 |
| 5,021,327 A | 6/1991 | Bunch et al. | ..... | 430/502 |
| 5,108,881 A | 4/1992 | Dickerson et al. | ..... | 430/502 |
| 5,344,749 A | 9/1994 | Kiekens et al. | ..... | 430/522 |
| 5,541,028 A | 7/1996 | Lee et al. | ..... | 430/30 |
| 5,576,156 A | 11/1996 | Dickerson | ..... | 430/502 |
| 5,952,162 A | 9/1999 | Dickerson et al. | ..... | 430/502 |

OTHER PUBLICATIONS

Visual optimization of radiograhic tone scale, H–C Lee et al, SPIE vol. 3036, 1997.

*Primary Examiner*—Richard L. Schilling
(74) *Attorney, Agent, or Firm*—J. Lanny Tucker

(57) ABSTRACT

High performance radiographic films exhibit visually adaptive contrast when imaged in radiographic imaging assemblies comprising an intensifying screen on both sides. These films having a single silver halide emulsion on each side of a film support and are free of particulate dyes that are conventionally used to control crossover. In addition, the films can be rapidly processed to provide the desired image having visually adaptive contrast, that is the upper scale contrast is at least 1.5 times the lower scale contrast. Thus, dense objects can be better seen at the higher densities of the radiographic image without any adverse sensitometric changes in the lower scale densities. These films are useful for general-purpose radiographic imaging using a wide variety of exposure and processing conditions.

19 Claims, 2 Drawing Sheets

VISUALLY ADAPTIVE RADIOGRAPHIC FILM AND IMAGING ASSEMBLY

FIELD OF THE INVENTION

This invention is directed to a general-purpose radiographic film that can be rapidly processed and directly viewed. In addition, the radiographic film of this invention also has what is known as "visually adaptive contrast" because it can provide higher contrast than normal in the higher density regions of an image. This invention also provides a film screen imaging assembly for radiographic purposes, and a method of processing the film to obtain a black-and-white image.

BACKGROUND OF THE INVENTION

Over one hundred years ago, W. C. Roentgen discovered X-radiation by the inadvertent exposure of a silver halide photographic element. In 1913, Eastman Kodak Company introduced its first product specifically intended to be exposed by X-radiation (X-rays). Today, radiographic silver halide films account for the overwhelming majority of medical diagnostic images. Such films provide viewable black-and-white images upon imagewise exposure followed by processing with the suitable wet developing and fixing photochemicals.

In medical radiography an image of a patient's anatomy is produced by exposing the patient to X-rays and recording the pattern of penetrating X-radiation using a radiographic film containing at least one radiation-sensitive silver halide emulsion layer coated on a transparent support. X-radiation can be directly recorded by the emulsion layer where only low levels of exposure are required. Because of the potential harm of exposure to the patient, an efficient approach to reducing patient exposure is to employ one or more phosphor-containing intensifying screens in combination with the radiographic film (usually both in the front and back of the film). An intensifying screen absorbs X-rays and emits longer wavelength electromagnetic radiation that the silver halide emulsions more readily absorb.

Another technique for reducing patient exposure is to coat two silver halide emulsion layers on opposite sides of the film support to form a "dual coated" radiographic film so the film can provide suitable images with less exposure. Of course, a number of commercial products provide assemblies of both dual coated films in combination with two intensifying screens to allow the lowest possible patient exposure to X-rays. Typical arrangements of film and screens are described in considerable detail for example in U.S. Pat. No. 4,803,150 (Dickerson et al), U.S. Pat. No. 5,021,327 (Bunch et al) and U.S. Pat. No. 5,576,156 (Dickerson).

Radiographic films that can be rapidly wet processed (that is, processed in an automatic processor within 90 seconds and preferably less than 45 seconds) are also described in the noted U.S. Pat. No. 5,576,156. Typical processing cycles include contacting with a black-and-white developing composition, desilvering with a fixing composition, and rinsing and drying. Films processed in this fashion are then ready for image viewing. In recent years, there has been an emphasis in the industry for more rapidly processing such films to increase equipment productivity and to enable medical professionals to make faster and better medical decisions.

As could be expected, image quality and workflow productivity (that is processing time) are of paramount importance in choosing a radiographic imaging system

[radiographic film and intensifying screen(s)]. One problem with known systems is that these requirements are not necessarily mutually inclusive. Some film/screen combinations provide excellent image quality but cannot be rapidly processed. Other combinations can be rapidly processed but image quality may be diminished. Both features are not readily provided at the same time.

In addition, the characteristic graphical plots [density vs. log E (exposure)] that demonstrate a film's response to a patient's attenuation of X-ray absorption indicate that known films do not generally provide desired sensitivity at the highest image densities where important pathology might be present. Traditionally, such characteristic sensitometric "curves" are S-shaped. That is the lower to midscale curve shape is similar to but inverted in comparison with the midscale to upper scale curve shape. Thus, these curves tend to be symmetrical about a density midpoint.

Another concern in the industry is the need to have radiographic films that as accurately as possible show all gradations of density differences against all backgrounds. It is well known that the typical response of the human eye to determining equal differences in density against a background of increasing density is not linear. In other words, typically it is more different for the human eye to see an object against a dark background than it is to see an object against a lighter background. Therefore, when an object is imaged (for example using X-rays, with or without intensifying screens) at the higher densities of the sensitometric curves, it is less readily apparent to the human eye when the radiographic film is being viewed. Obviously, this is not a desirable situation when medical images are being viewed and used for important diagnostic purposes.

In order to compensate for this nonlinearity of response by the human eye, it would be desirable to somehow increase radiographic film contrast only at the higher densities without changing contrast or other properties at lower densities. The result of such a modification would be a unique sensitometric curve shape where the contrast is higher than normal in the higher density regions. Such a curve shape is considered as providing "visually adaptive contrast" (VAC).

While this type of sensitometry sounds like a simple solution to a well known problem, achieving it in complicated radiographic film/screen systems is not simple and is not readily apparent from what is already known in the art. Moreover, one cannot predict that even if VAC is obtained with a particular radiographic film, other necessary image properties and rapid processability may be adversely affected.

Exposure and processing conditions for radiographic films vary widely throughout the world. Processing equipment ranges from very expensive sophisticated automatic film processors to simple shallow tray, low cost processors for manual processing. Exposure can be carried out with modern triple-phase X-ray generators or older single-phase generators. These older generators usually have low power and are quite variable in their output of X-radiation.

Because of the wide variability of the conditions for using radiographic films, there is a need in the industry for a radiographic film that is readily exposed and processed to provide a sensitometric curve shape that is suited to record variables exposures. Such a film could be used throughout the world under a wide variety of conditions without sacrificing quality of image and processability.

SUMMARY OF THE INVENTION

The present invention provides a solution to the noted problems with a radiographic silver halide film comprising a support having first and second major surfaces and that is capable of transmitting X-radiation, the film having disposed on the first major support surface, one or more hydrophilic colloid layers including a single silver halide emulsion layer, and on the second major support surface, one or more hydrophilic colloid layers including a single silver halide emulsion layer, each of the silver halide emulsion layers comprising silver halide grains that (a) have the same or different composition in each silver halide emulsion layer, (b) account for at least 50% of the total grain projected area within each silver halide emulsion layer, (c) have an average thickness of less than 0.3 $\mu$m, and (d) have an average aspect ratio of greater than 5, all hydrophilic layers of the film being fully forehardened and wet processing solution permeable for image formation within 45 seconds, the film being free of particulate dyes, and the film being capable of providing an image with visually adaptive contrast whereby the upper scale contrast is at least 1.5 times the lower scale contrast of a sensitometric D vs. log E curve.

This invention also provides a radiographic imaging assembly comprising the radiographic film described above provided in combination with an intensifying screen on either side of the film.

Further, this invention provides a method comprising contacting the radiographic film described above, sequentially, with a black-and-white developing composition and a fixing composition, the method being carried out within 90 seconds to provide a black-and-white image with visually adaptive contrast whereby the upper scale contrast is at least 1.5 times the lower scale contrast of a sensitometric D vs. log E curve.

The present invention provides a radiographic film and film/intensifying screen assembly that gives the medical professional a greater ability to see an object against a dark (or high density) background. Therefore, when an object is imaged using the film of this invention at the higher densities, the object is more readily apparent to the human eye.

In order to compensate for the nonlinearity of response by the human eye, the radiographic film contrast has been increased only at the higher densities without changing contrast or other properties at lower densities. The result of such a modification is a unique sensitometric curve shape where the contrast is higher than normal in the higher density regions. Thus, the films of this invention are considered as providing "visually adaptive contrast" (VAC) as we defined it.

Moreover, the film of this invention has specifically designed emulsion layers to provide flexibility for use with a wide variety of exposure and processing conditions needed for a general purpose film throughout the world.

In addition, all other desirable sensitometric properties are maintained and the films can be rapidly processed in conventional processing equipment and compositions.

DETAILED DESCRIPTION OF THE INVENTION

Figure 1:
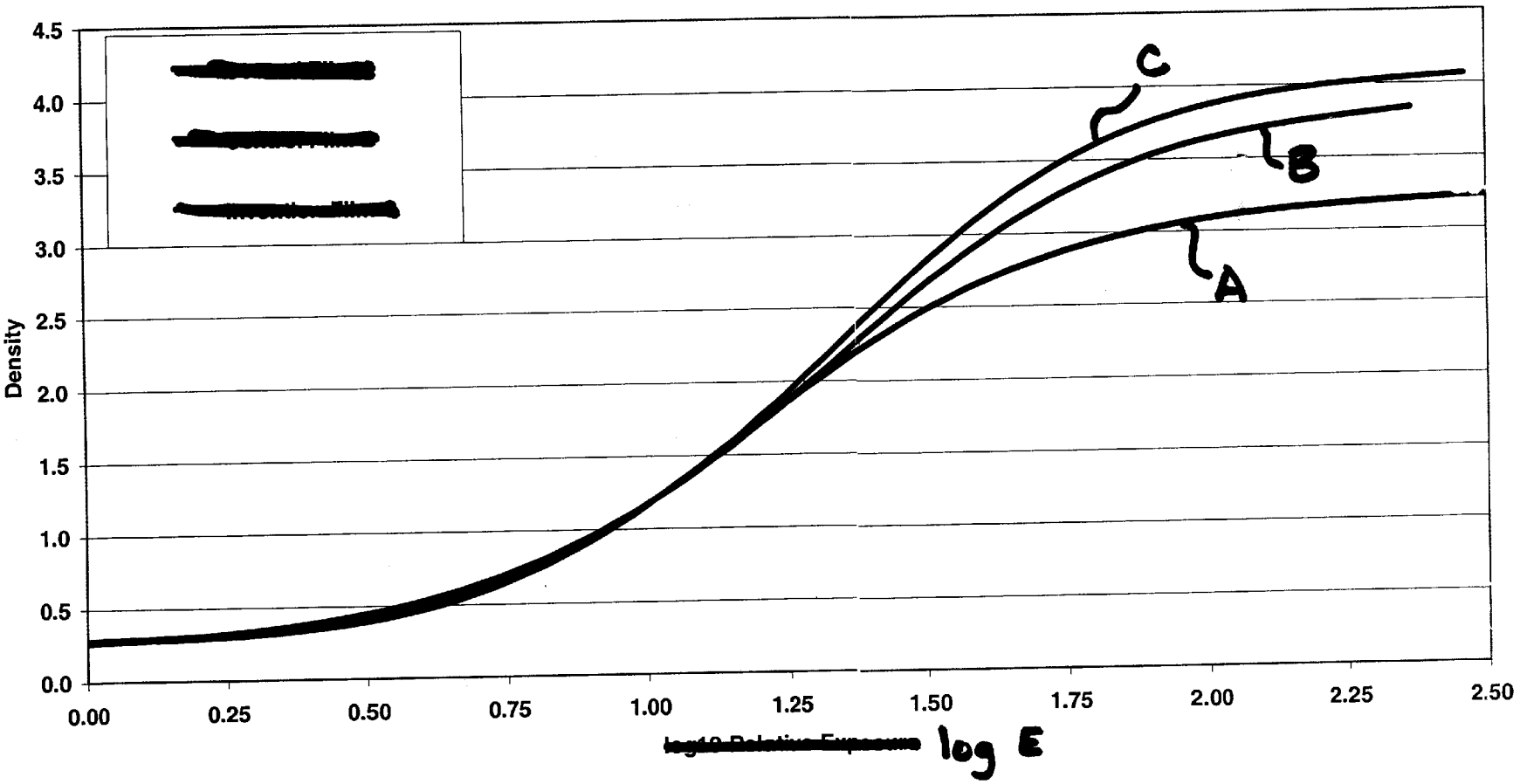
FIG. 1 is graphical representation of characteristic density vs. log E (exposure) for Films A, B and C of the Example described below.

The term "contrast" as herein employed indicates the average contrast derived from a characteristic curve of a radiographic element using as a first reference point (1) a density ($D_1$) of 0.25 above minimum density and as a second reference point (2) a density ($D_2$) of 2.0 above minimum density, where contrast is $\Delta D$ (i.e. 1.75) $\div \Delta \log_{10} E(\log_{10} E_2 - \log_{10} E_1)$, $E_1$ and $E_2$ being the exposure levels at the reference points (1) and (2).

"Lower scale contrast" is the slope of the characteristic curve measured between of a density of 0.85 to the density achieved by shifting −0.3 log E units.

"Upper scale contrast" is the slope of the characteristic curve measured between a density of 1.5 above $D_{min}$, to 2.85 above $D_{min}$.

Photographic "speed" refers to the exposure necessary to obtain a density of at least 1.0 plus $D_{min}$.

"Dynamic range" refers to the range of exposures over which useful images can be obtained.

"Gamma" refers to the instantaneous rate of change of the D vs. logE sensitometric curve at any given logE value.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "tabular grain" is used to define a silver halide grain having two parallel crystal faces that are clearly larger than any remaining crystal faces and having an aspect ratio of at least 2. The term "tabular grain emulsion" refers to a silver halide emulsion in which the tabular grains account for more than 50% of the total grain projected area.

The term "covering power" is used to indicate 100 times the ratio of maximum density to developed silver measured in $mg/dm^2$.

The term "rare earth" is used to refer to elements having an atomic number of 39 or 57 to 71.

The term "front" and "back" refer to locations nearer to and further from, respectively, the source of X-radiation than the support of the film.

The term "dual-coated" is used to define a radiographic film having silver halide emulsion layers disposed on both the front- and backsides of the support.

The radiographic films of this invention include a flexible support having disposed on both sides thereof a single silver halide emulsion layer and optionally one or more non-radiation sensitive hydrophilic layer(s). The silver halide emulsions in the single layers can be the same or different, and can comprise mixtures of various silver halide emulsions. In preferred embodiments, the film has the same silver halide emulsions on both sides of the support. It is also preferred that the films have a protective overcoat (described below) over the silver halide emulsion layer on each side of the support.

The support can take the form of any conventional radiographic clement support that is X-radiation and light transmissive. Useful supports for the films of this invention can be chosen from among those described in *Research Disclosure,* September 1996, Item 38957 XV. Supports and *Research Disclosure,* Vol. 184, August 1979, Item 18431, XII. Film Supports. *Research Disclosure* is published by Kenneth Mason Publications, Ltd., Dudley House, 12 North Street, Emsworth, Hampshire P010 7DQ England.

The support is a transparent film support. In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure,* Item 38957, Section XV Supports, cited above, attention is directed particularly to paragraph (2) that describes subbing layers, and paragraph (7) that describes preferred polyester film supports.

In the more preferred embodiments, at least one non-light sensitive hydrophilic layer is included with the single silver halide emulsion layer on each side of the film support. This layer may be called an interlayer or overcoat, or both.

The silver halide emulsion layers comprise one or more types of silver halide grains responsive to X-radiation. Silver halide grain compositions particularly contemplated include those having at least 80 mol % bromide (preferably at least 98 mol % bromide) based on total silver. Such emulsions include silver halide grains composed of, for example, silver bromide, silver iodobromide, silver chlorobromide, silver iodochlorobromide, and silver chloroiodobromide. Iodide is generally limited to no more than 3 mol % (based on total silver) to facilitate more rapid processing. Preferably iodide is limited to no more than 2 mol % (based on total silver) or eliminated entirely from the grains.

The silver halide grains in each silver halide emulsion unit (or silver halide emulsion layers) can be the same or different, or mixtures of different types of grains.

The silver halide grains useful in this invention can have any desirable morphology including, but not limited to, cubic, octahedral, tetradecahedral, rounded, spherical or other non-tabular morphologies, or be comprised of a mixture of two or more of such morphologies. Preferably, the grains are tabular grains and the emulsions are tabular grain emulsions in each silver halide emulsion layer.

In addition, different silver halide emulsion layers can have silver halide grains of the same or different morphologies as long as at least 50% of the grains are tabular grains. For cubic grains, the grains generally have an ECD of at least 0.8 $\mu$m and less than 3 $\mu$m (preferably from about 0.9 to about 1.4 $\mu$m). The useful ECD values for other non-tabular morphologies would be readily apparent to a skilled artisan in view of the useful ECD values provided for cubic and tabular grains.

Generally, the average ECD of tabular grains used in the films is greater than 0.9 $\mu$m and less than 4.0 $\mu$m, and preferably greater than 1 and less than 3 $\mu$m. Most preferred ECD values are from about 1.6 to about 4.5 $\mu$m. The average thickness of the tabular grains is generally at least 0.1 and no more than 0.3 $\mu$m, and preferably at least 0.12 and no more than 0.18 $\mu$m.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

Generally, at least 50% (and preferably at least 90%) of the silver halide grain projected area in each silver halide emulsion layer is provided by tabular grains having an average aspect ratio greater than 5, and more preferably greater than 10. The remainder of the silver halide projected area is provided by silver halide grains having one or more non-tabular morphologies.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et al), U.S. Pat. No. 4,425,426 (Abbott et al), U.S. Pat. No. 4,439,520 (Kofron et al), U.S. Pat. No. 4,434,226 (Wilgus et al), U.S. Pat. No. 4,435,501 (Maskasky), U.S. Pat. No. 4,713,320 (Maskasky), U.S. Pat. No. 4,803,150 (Dickerson et al), U.S. Pat. No. 4,900,355 (Dickerson et al), U.S. Pat. No. 4,994,355 (Dickerson et al), U.S. Pat. No. 4,997,750 (Dickerson et al), U.S. Pat. No. 5,021,327 (Bunch et al), U.S. Pat. No. 5,147,771 (Tsaur et al), U.S. Pat. No. 5,147,772 (Tsaur et al), U.S. Pat. No. 5,147,773 (Tsaur et al), U.S. Pat. No. 5,171,659 (Tsaur et al), U.S. Pat. No. 5,252,442 (Dickerson et al), U.S. Pat. No. 5,370,977 (Zietlow), U.S. Pat. No. 5,391,469 (Dickerson), U.S. Pat. No. 5,399,470 (Dickerson et al), U.S. Pat. No. 5,411,853 (Maskasky), U.S. Pat. No. 5,418,125 (Maskasky), U.S. Pat. No. 5,494,789 (Daubendiek et al), U.S. Pat. No. 5,503,970 (Olm et al), U.S. Pat. No. 5,536,632 (Wen et al), U.S. Pat. No. 5,518,872 (King et al), U.S. Pat. No. 5,567,580 (Fenton et al), U.S. Pat. No. 5,573,902 (Daubendiek et al), U.S. Pat. No. 5,576,156 (Dickerson), U.S. Pat. No. 5,576,168 (Daubendiek et al), U.S. Pat. No. 5,576,171 (Olm et al), and U.S. Pat. No. 5,582,965 (Deaton et al). The patents to Abbott et al, Fenton et al, Dickerson and Dickerson et al are also cited and incorporated herein to show conventional radiographic film features in addition to gelatino-vehicle, high bromide (≧80 mol % bromide based on total silver) tabular grain emulsions and other features useful in the present invention.

A variety of silver halide dopants can be used, individually and in combination, to improve contrast as well as other common properties, such as speed and reciprocity characteristics. A summary of conventional dopants to improve speed, reciprocity and other imaging characteristics is provided by *Research Disclosure,* Item 38957, cited above, Section I. Emulsion grains and their preparation, sub-section D. Grain modifying conditions and adjustments, paragraphs (3), (4) and (5).

A general summary of silver halide emulsions and their preparation is provided by *Research Disclosure,* Item 38957, cited above, Section I. Emulsion grains and their preparation. After precipitation and before chemical sensitization the emulsions can be washed by any convenient conventional technique using techniquies disclosed by *Research Disclosure,* Item 38957, cited above, Section III. Emulsion washing.

The emulsions can be chemically sensitized by any convenient conventional technique as illustrated by *Research Disclosure,* Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure,* Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindcnes, and others described in U.S. Pat. No. 5,800,976 (Dickerson et al) that is incorporated herein by reference for the teaching of the sulfur-containing covering power enhancing compounds. Such compounds are generally present at concentrations of at least 20 mg/silver mole, and preferably of at least 30 mg/silver mole. The concentration can generally be as much as 2000 mg/silver mole and preferably as much as 700 mg/silver mole.

Obtaining the desired photographic speed in the noted silver halide emulsion layers is not a difficult thing for someone skilled in the art. For example, speed can be achieved and adjusted in a given silver halide emulsion by increasing silver halide emulsion grain size or increasing the efficiency of chemical or spectral sensitization.

The silver halide emulsion layers and other hydrophilic layers on both sides of the support of the radiographic film generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure,* Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polymethacrylates), polystyrenes and polyacrylamides (including polymethacrylamides). Dextrans can also be used. Examples of such materials are described for example in U.S. Pat. No. 5,876,913 (Dickerson et al), incorporated herein by reference.

The silver halide emulsion layers (and other hydrophilic layers) in the radiographic films of this invention are generally fully hardened using one or more conventional hardeners. Thus, the amount of hardener in each silver halide emulsion and other hydrophilic layer is generally at least 1.5% and preferably at least 2%, based on the total dry weight of the polymer vehicle in each layer.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (e.g., mucochloric and mucobromic acids), onium-substituted acroleins, vinyl sulfones containing other hardening functional groups, polymeric hardeners such as dialdehyde starches, and copoly(acrolein-methacrylic acid).

On each side of the radiographic film, the minimal total level of silver is generally at least 16 mg/dm$^2$ and generally no more than 18 mg/dm$^2$. In addition, the total coverage of polymer vehicle per side (that is, all layers on that side) is generally no more than 40 mg/dm$^2$, preferably no more than 38 mg/dm$^2$, and generally at least 34 mg/dm$^2$. The amounts of silver and polymer vehicle on the two sides of the support can be the same or different. These amounts refer to dry weights and are approximate (that is, "about").

The radiographic films generally include a surface protective overcoat on each side of the support that is typically provided for physical protection of the emulsion layers. Each protective overcoat can be sub-divided into two or more individual layers. For example, protective overcoats can be sub-divided into surface overcoats and interlayers (between the overcoat and silver halide emulsion layer). In addition to vehicle features discussed above the protective overcoats can contain various addenda to modify the physical properties of the overcoats. Such addenda are illustrated by *Research Disclosure,* Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. It is quite common to locate some emulsion compatible types of protective overcoat addenda, such as anti-matte particles, in the interlayers. The overcoat on at least one side of the support can also include a blue toning dye or a tetraazaindene (such as 4-hydroxy-6-methyl-1,3,3a,7-tetraazaindene) if desired.

The protective overcoat is generally comprised of a hydrophilic colloid vehicle, chosen from among the same types disclosed above in connection with the emulsion layers. In conventional radiographic films protective overcoats are provided to perform two basic functions. They provide a layer between the emulsion layers and the surface of the element for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

An essential feature of the radiographic films of this invention is the absence of one or more microcrystalline particulate dyes in the films. Examples of such particulate dyes are described in U.S. Pat. No. 5,021,327 (noted above, Cols. 11–50) and U.S. Pat. No. 5,576,156 (noted above, Cols. 6–7), both incorporated herein by reference for description of the dyes. Classes of particulate dyes are nonionic polymethine dyes that include the merocyanine, oxonol, hemioxonol, styryl and arylidene dyes. One such dye that is used in conventional films is 1-(4'-carboxyphenyl)-4-(4'-dimethylaminobenzylidene)-3-ethoxycarbonyl-2-pyrazolin-5-one (identified as Dye XOC-1 herein).

The films of this invention exhibit an upper scale contrast (USC) of at least 3, and preferably at least 3.5. In addition, the ratio of USC to LSC is at least 1.5 and preferably at least 1.8. These features provide what is described above as visually adaptive contrast (VAC). This attribute is similar to "perceptually linearized contrast" or visually optimized tone scale as described for example by Lee et al, *SPIE* Vol. 3036, pp. 118–129, 1997.

The radiographic imaging assemblies of the present invention are composed of a radiographic film as described herein and intensifying screens adjacent the front and back of the radiographic film. The screens are typically designed to absorb X-rays and to emit electromagnetic radiation having a wavelength greater than 300 nm. These screens can take any convenient form providing they meet all of the usual requirements for use in radiographic imaging, as described for example in U.S. Pat. No. 5,021,327 (noted above), incorporated herein by reference. A variety of such screens are commercially available from several sources, including by not limited to, LANEX™, X-SIGHT™ and InSight™ Skeletal screens available from Eastman Kodak Company. The front and back screens can be appropriately chosen depending upon the type of emissions desired, the photicity desired, whether the films are symmetrical or asymmetrical, film emulsion speeds, and crossover.

Exposure and processing of the radiographic films of this invention can be undertaken in any convenient conventional manner. The exposure and processing techniques of U.S. Pat. Nos. 5,021,327 and 5,576,156 (both noted above), are typical for processing radiographic films. Other processing compositions (both developing and fixing compositions) are described in U.S. Pat. No. 5,738,979 (Fitterman et al), U.S. Pat. No. 5,866,309 (Fitterman et al), U.S. Pat. No. 5,871,890 (Fitterman et al), U.S. Pat. No. 5,935,770 (Fitterman et al), U.S. Pat. No. 5,942,378 (Fitterman et al), all incorporated herein by reference. The processing compositions can be supplied as single- or multi-part formulations, and in concentrated form or as more diluted working strength solutions.

It is particularly desirable that the films of this invention be processed (dry-to-dry) within 90 seconds, and preferably within 60 seconds, and at least 20 seconds, including developing, fixing, any washing (or rinsing), and drying. Such processing can be carried out in any suitable processing equipment including but not limited to, a Kodak X-OMAT™ RA 480 processor that can utilize Kodak Rapid Access processing chemistry. Other "rapid access processors" are described for example in U.S. Pat. No. 3,545,971 (Barnes et al) and EP-A-0 248,390 (Akio et al). Preferably, the black-and-white developing compositions used during processing are free of any photographic film (for example, gelatin) hardeners, such as glutaraldehyde.

Since rapid access processors employed in the industry vary in their specific processing cycles and selections of processing compositions, the preferred radiographic films satisfying the requirements of the present invention are specifically identified as those that are capable of dry-to-dry processing according to the following reference conditions:

| | |
|---|---|
| Development | 11.1 seconds at 35° C., |
| Fixing | 9.4 seconds at 35° C., |
| Washing | 7.6 seconds at 35° C., |
| Drying | 12.2 seconds at 55–65° C. |

Any additional time is taken up in transport between processing step. Typical black-and-white developing and fixing compositions are as follows:

Radiographic kits of the present invention can include one or more samples of radiographic film of this invention, one or more intensifying screens used in the radiographic imaging assemblies, and/or one or more suitable photographic processing compositions (for example black-and-white developing and fixing compositions). Preferably, the kit includes all of these components. Alternatively, the radiographic kit can include a radiographic imaging assembly as described herein and one or more of the noted photographic processing compositions.

The following example is provided for illustrative purposes, and is not meant to be limiting in any way.

EXAMPLE

Radiographic Film A (Control)

Radiographic Film A was a dual coated having silver halide emulsions on both sides of a blue-tinted 178 $\mu$m transparent poly(ethylene terephthalate) film support. One side of the support has a silver halide emulsion comprising a blend of two silver bromide tabular emulsions at a weight ratio of 45:55. The opposite side of the support has a silver halide emulsion layer comprising a blend of two emulsions at a weight ratio of 40:60. Each silver halide emulsion was green-sensitized. The emulsions were chemically sensitized with sodium thiosulfate, potassium tetrachloroaurate, sodium thiocyanate and potassium selenocyanate, and spectrally sensitized with 400 mg/Ag mole of anhydro-5,5-dichloro-9-ethyl-3,3'-bis(3-sulfopropyl)oxacarbocyanine hydroxide, followed by 300 mg/Ag mole of potassium iodide.

Radiographic Film A had the following layer arrangement:

Overcoat
Interlayer
High Contrast Emulsion Layer
Crossover Control Layer
Support
Crossover Control Layer
Low Contrast Emulsion Layer
Interlayer
Overcoat The noted layers were prepared from the following formulations.

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 $\mu$m) | 0.11 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| High Contrast Emulsion Layer Formulation | |
| T-grain emulsion (AgBr 2.7 × 0.13 $\mu$m) | 9.5 |
| T-grain emulsion (AgBr 2.0 × 0.10 $\mu$m) | 14.2 |
| Gelatin vehicle | 21.5 |
| 4-hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethyl ether hardener | 2.4% based on total gelatin on the side |
| Crossover Control Emulsion Layer Formulation | |
| Magenta microcrystalline filter dye (XOC-1) | 2.5 |
| Gelatin | 6.7 |
| Low Contrast Emulsion Layer Formulation | |
| T-grain emulsion (AgBr 3.6 × 0.13 $\mu$m) | 7.8 |
| T-grain emulsion (AgBr 1.2 × 0.13 mum) | 10.1 |
| Gelatin vehicle | 21.5 |
| 4-hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |
| Bisvinylsulfonylmethyl ether hardener | 2.4% based on total gelatin on the side |

Radiographic Film B (Control):

Radiographic Film B has the following layer arrangement and formulations on each side of the support.

Overcoat
Interlayer
Emulsion Layer

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 $\mu$m) | 0.11 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |
| Emulsion Layer Formulation | |
| T-grain emulsion (AgBr 3.7 × 0.13 $\mu$m) | 3.2 |
| T-grain emulsion (AgBr 2.0 × 0.10 $\mu$m) | 9.9 |
| T-grain emulsion (AgBr 1.2 × 0.13 $\mu$m) | 4.1 |
| Gelatin vehicle | 28 |
| 4-hydroxy-6-methyl-1,3,3a,7-tetraazaindene | 2.1 g/Ag mole |
| Potassium nitrate | 1.8 |
| Ammonium hexachloropalladate | 0.0022 |
| Maleic acid hydrazide | 0.0087 |
| Sorbitol | 0.53 |
| Glycerin | 0.57 |
| Potassium bromide | 0.14 |
| Resorcinol | 0.44 |

Radiographic Film C (Invention)

Radiographic Film C is within the present invention and had the following layer arrangement and formulations on both sides of the film support:

Overcoat
Interlayer
Emulsion Layer

| | Coverage (mg/dm$^2$) |
|---|---|
| Overcoat Formulation | |
| Gelatin vehicle | 3.4 |
| Methyl methacrylate matte beads | 0.14 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Whale oil lubricant | 0.15 |
| Interlayer Formulation | |
| Gelatin vehicle | 3.4 |
| AgI Lippmann emulsion (0.08 $\mu$m) | 0.11 |
| Carboxymethyl casein | 0.57 |
| Colloidal silica (LUDOX AM) | 0.57 |
| Polyacrylamide | 0.57 |
| Chrome alum | 0.025 |
| Resorcinol | 0.058 |
| Nitron | 0.044 |

-continued

| | Coverage (mg/dm$^2$) |
|---|---|
| Emulsion Layer Formulation | |
| T-grain emulsion (AgBr 3.7 × 0.13 μm) | 2.2 |
| T-grain emulsion (AgBr 2.0 × 0.10 μm) | 8.9 |
| T-grain emulsion (AgBr 1.2 × 0.13 μm) | 6.0 |
| Gelatin vehicle | 28.5 |
| 4-hydroxy-6-methyl-1,3,3a,7-tetraazaindene | 2.1 g/Ag mole |
| Potassium nitrate | 0.83 |
| Ammonium hexachloropalladate | 0.001 |
| Maleic acid hydrazide | 0.0044 |
| Sorbitol | 0.32 |
| Glycerin | 0.35 |
| Potassium bromide | 0.083 |
| Resorcinol | 0.26 |
| Bisvinylsulfonylmethlyether | 2.5% based on total gelatin in all layers on the side |

Films B and C described in this Example were each placed between two commercially available LANEX Regular intensifying screens to form imaging assemblies. Film A was used with a commercially available InSight™ HC intensifying screen.

In this contest, each film was exposed to 70 KVp X-radiation, varying, either current (mA) or time using a 3-phase Picker Medical X-Ray Unit (Model VTX-650) containing filtration up to 3 mm of aluminum. Sensitometric gradations in exposure were achieved using, a 21-increment (0.1 logE) aluminum step wedge of varying thickness.

Processing of the exposed film samples for sensitometric evaluation was carried out using a processor commercially available under the trademark KODAK RP X-OMAT film Processor M6A-N. Development was carried out using the following black-and-white developing composition:

| | |
|---|---|
| Hydroquinone | 30 g |
| Phenidone | 1.5 g |
| Potassium hydroxide | 21 g |
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were in contact with the developer in each instance for less than 90 seconds. Fixing for all experiments in this example was carried out using KODAK RP X-OMAT LO Fixer and Replenisher fixing composition (available from Eastman Kodak Company).

Rapid processing has evolved over the last several years as a way to increase productivity in busy hospitals without compromising image quality or sensitometric response. Where 90 second processing times were once the standard, below 40 seconds processing is becoming the standard in medical radiography. One such example of a rapid processing system is the commercially available KODAK Rapid Access (RA) processing system that includes a line of X-ray sensitive films available as T-MAT-RA radiographic films that feature fully forehardened emulsions in order to maximize film diffusion rates and minimize film drying. Processing chemistry for this process is also available. As a result of the film being fully forehardened, glutaraldehyde (a common hardening agent) can be removed from the developer solution, resulting in ecological and safety advantages (see KODAK KWIK Developer below). The developer and fixer designed for this system are Kodak X-OMAT RA/30 chemicals. A commercially available processor that allows for the rapid access capability is the Kodak X-OMAT RA 480 processor. This processor is capable of running in 4 different processing cycles. "Extended" cycle is for 160 seconds, and is used for mammography where longer than normal processing results in higher speed and contrast. "Standard" cycle is 82 seconds, "Rapid Cycle" is 55 seconds and "KWIK/RA" cycle is 40 seconds (see KODAK KWIK Developer below). A proposed new "Super KWIK" cycle is intended to be 30 seconds (see KODAK Super KWIK Developer below). The two KWIK cycles (30 & 40 seconds) use the RA/30 chemistries while the longer time cycles use standard RP X-OMAT chemistry. The following Table I shows typical processing times (seconds) for these various processing cycles.

TABLE I

| Cycle | Extended | Standard | Rapid | KWIK | Super KWIK |
|---|---|---|---|---|---|
| Developer | 44.9 | 27.6 | 15.1 | 11.1 | 8.3 |
| Fixer | 37.5 | 18.3 | 12.9 | 9.4 | 7.0 |
| Wash | 30.1 | 15.5 | 10.4 | 7.6 | 5.6 |
| Drying | 47.5 | 21.0 | 16.6 | 12.2 | 9.1 |
| Total | 160.0 | 82.4 | 55 | 40.3 | 30.0 |

The black-and-white developer useful for the KODAK KWIK cycle contained the following components:

| | |
|---|---|
| Hydroquinone | 32 g |
| 4-Hydroxymethyl-4-methyl-1-phenyl-3-pyrazolidone | 6 g |
| Potassium bromide | 2.25 g |
| 5-Methylbenzotriazole | 0.125 g |
| Sodium sulfite | 160 g |
| Water to 1 liter, pH 10.35 | |

The black-and-white developer used for the KODAK Super KWIK cycle contained the following components:

| | |
|---|---|
| Hydroquinone | 30 g |
| 4-Hydroxymethyl-4-methyl-1-phenyl-3-pyrazolidone | 3 g |
| Phenylmercaptotetrazole | 0.02 g |
| 5-Nitroindazole | 0.02 g |
| Glutaraldehyde | 4.42 g |
| Diethylene glycol | 15 g |
| Sodium bicarbonate | 7.5 g |
| VERSENEX 80 | 2.8 g |
| Potassium sulfite | 71.48 g |
| Sodium sulfite | 11.75 g |
| Water to 1 liter, pH 10.6 | |

The "% Drying" was determined by feeding an exposed film flashed to result in a density of 1.0 into an X-ray processing machine. As the film just exits the drier section, the processing machine was stopped and the film was removed. Roller marks from the processing machine can be seen on the film where the film has not yet dried. Marks from 100% of the rollers in the drier indicate the film has just barely dried. Values less than 100% indicate the film has dried partway into the drier. The lower the value the better the film is for drying.

"Crossover" measurements were obtained by determining the density of the silver developed in each of the silver halide emulsion layers, in the silver halide emulsion layer adjacent the intensifying screen, and in the non-adjacent silver halide emulsion layer separated from the film support. By plotting the density produced by each silver halide emulsion layer versus the steps of a conventional aluminum step wedge (a measure of exposure), a characteristic sensitometric curve was generated for each silver halide emulsion layer. A higher density was produced for a given exposure of the silver halide emulsion layer adjacent the film support. Thus, the two sensitometric curves were offset in speed. At three different density levels in the relatively straight-line portions of the sensitometric curves between the toe and shoulder regions of the curves, the difference in speed (Δ logE) between the two sensitometric curves was measured. These differences were then averaged and used in the following equation to calculate the % crossover:

$$\%\ \text{Crossover} = \frac{1}{\text{antilog}(\Delta \log E) + 1} \times 100$$

The data in the following Table II show a relative comparison of the three imaging assemblies A, B and C using radiographic Films A, B and C, respectively. Film A (Control) was a high-resolution film exhibiting a visually adaptive curve shape. That is, the ratio of USC to LSC was good but the film was incapable of rapid cycle processing. Film A exhibited a higher USC than Film B but the USC:LSC ratio was greater than 1.

Film C could be rapidly processed and exhibited high USC and a USC:LSC ratio significantly greater than 1 (thus, it exhibited visually adaptive contrast). Such a film can be used to record information at higher densities with greater accuracy and can be viewed using conventional light boxes.

TABLE III below shows another advantage of Film C over Film B. It shows the gamma values (contrast, the first derivative of the D vs. logE curve) as a function of density. As can be seen from the data, both films have similar gamma values up to a density of 1.5 but at higher densities, Film C has higher gamma values out to a density of 3.0. Such a film shape allows for greater exposure latitude control since information can be recorded even at higher densities where the human eye is less sensitive. In addition, the use of "hot-lighting" is possible using Film C to visualize the very high density information. Film B cannot be used in this manner because of its low gamma values at these densities.

Figure 2:
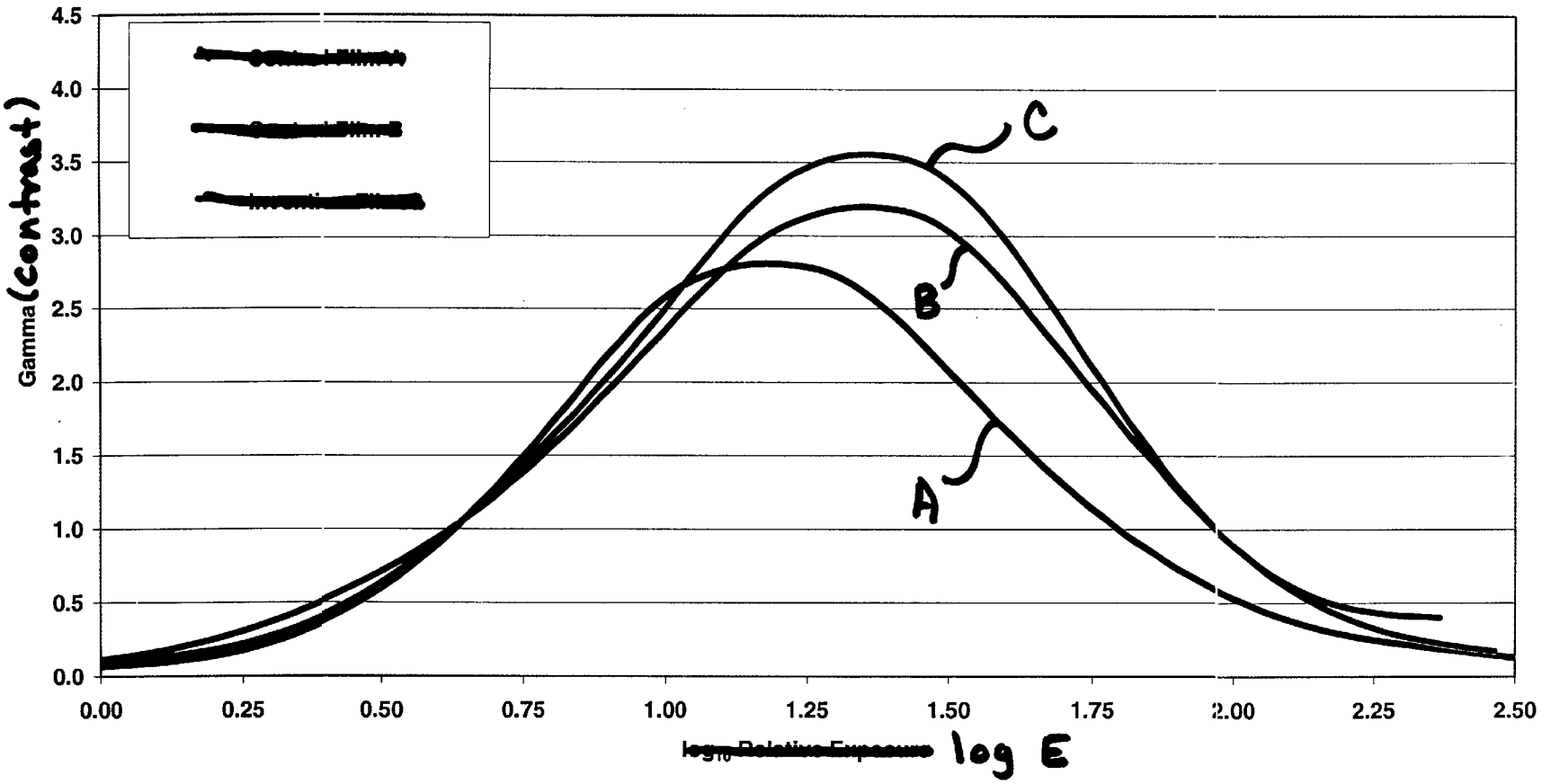
FIG. 2 is a graphical representation of gamma (contrast) vs. log E (exposure) for Films A, B and C of the Example described below.

These results are also apparent from FIGS. 1 and 2 in which Curves A, B and C represent sensitometric data for Films A, B and C respectively.

TABLE II

| Film | Speed | Contrast | % Cross-over | Drying | LSC* | USC** | Ratio USC/LSC |
|---|---|---|---|---|---|---|---|
| Control A | 0 | 2.4 | 3 | >100% | 1.8 | 2.8 | 1.5 |
| Control B | +0.1 | 2.3 | 30 | 50% | 1.8 | 1.57 | 0.8 |
| Invention C | +0.11 | 2.4 | 27 | 50% | 1.8 | 2.7 | 1.5 |

*LSC = lower scale contrast
**USC = upper scale contrast

TABLE III

| Film | Gamma Density 0.5 | Gamma Density 1.0 | Gamma Density 1.5 | Gamma Density 2.0 | Gamma Density 2.5 | Gamma Density 3.0 |
|---|---|---|---|---|---|---|
| Control B | 1.0 | 2.0 | 2.65 | 2.45 | 1.75 | 0.6 |
| Invention C | 1.0 | 2.0 | 2.65 | 2.7 | 2.65 | 2.25 |

The invention has been described in detail with particular reference to preferred embodiments thereof, but it will be understood that variations and modifications can be effected within the spirit and scope of the invention.

We claim:

1. A radiographic silver halide film comprising a support having first and second major surfaces and that is capable of transmitting X-radiation, said film having disposed on said first major support surface, one or more hydrophilic colloid layers including a single silver halide emulsion layer, and on said second major support surface, one or more hydrophilic colloid layers including a single silver halide emulsion layer, each of said silver halide emulsion layers comprising silver halide grains that (a) have the same or different composition in each silver halide emulsion layer, (b) account for at least 50% of the total grain projected area within each silver halide emulsion layer, (c) have an average thickness of less than 0.3 μm, and (d) have an average aspect ratio of greater than 5, all hydrophilic layers of the film being fully forehardened and wet processing solution permeable for image formation within 45 seconds, said film being free of particulate dyes, and said film being capable of providing an image with visually adaptive contrast whereby the upper scale contrast is at least 1.5 times the lower scale contrast of a sensitometric D vs. log E curve.

2. The film of claim 1 that is capable of providing an image with visually adaptive contrast whereby said upper level contrast is at least 1.8 times said lower scale contrast.

3. The film of claim 1 wherein said tabular silver halide grains of each silver halide emulsion are tabular silver halide grains composed of at least 80% bromide based on total silver.

4. The film of claim 3 wherein tabular silver halide grains of each silver halide emulsion are composed of at least 98% bromide based on total silver.

5. The film of claim 1 wherein said silver halide grains are tabular grains having an ECD of from about 1.6 to about 4.5 μm, and an average thickness of from about 0.1 to about 0.18 μm.

6. The film of claim 5 wherein at least 90% of the silver halide grain projected area in each silver halide emulsion layer is provided by tabular silver halide grains having an aspect ratio greater than 10.

7. The film of claim 1 wherein the single silver halide emulsion layers on each side of said support comprise at least one of the same silver halide emulsions.

8. The film of claim 1 wherein at least one of the silver halide emulsion layers comprises a mixture of two or more different silver halide emulsions.

9. The film of claim 1 further comprising an overcoat over said silver halide emulsion on each side of said film support.

10. The film of claim 1 wherein the total polymer vehicle on each side is no more than 40 mg/dm$^2$.

11. The film of claim 10 wherein the total polymer vehicle on each side is from about 32 to about 36 mg/dm$^2$.

12. The film of claim 1 wherein the total silver on each side is from about 16 to about 18 mg/dm$^2$.

13. A radiographic imaging assembly comprising the radiographic film of claim 1 provided in combination with an intensifying screen on either side of said film.

14. A method comprising contacting the radiographic film of claim 1, sequentially, with a black-and-white developing composition and a fixing composition, said method being carried out within 90 seconds to provide a black-and-white image with visually adaptive contrast whereby the upper scale contrast is at least 1.5 times the lower scale contrast of a sensitometric D vs. log E curve.

15. The method of claim 14 wherein said black-and-white developing composition is free of any photographic film hardeners.

16. The method of claim 14 being carried out within 60 seconds.

17. The method of claim 16 being carried out for from about 20 to about 60 seconds.

18. A radiographic kit comprising the radiographic film of claim 1 and one or more of the following:

a) an intensifying screen, b) a black-and-white developing composition, and c) a fixing composition.

19. A radiographic kit comprising the radiographic imaging assembly of claim 13 and one or more photographic processing compositions.

* * * * *